US006483405B1

(12) United States Patent
Toda et al.

(10) Patent No.: US 6,483,405 B1
(45) Date of Patent: Nov. 19, 2002

(54) DIELECTRIC FILTER, DUPLEXER AND COMMUNICATION APPARATUS

(75) Inventors: Jun Toda, Ishikawa-ken (JP); Motoharu Hiroshima, Ishikawa-ken (JP); Hideyuki Kato, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/429,596

(22) Filed: Oct. 28, 1999

(30) Foreign Application Priority Data

Oct. 29, 1998 (JP) ..... 10-308381

(51) Int. Cl.[7] ..... H01P 1/20; H01P 5/12
(52) U.S. Cl. ..... 333/206; 333/202; 333/134
(58) Field of Search ..... 333/202, 206, 333/207, 134

(56) References Cited

U.S. PATENT DOCUMENTS

| | | | | |
|---|---|---|---|---|
| 5,124,676 A | | 6/1992 | Ueno | |
| 5,489,882 A | * | 2/1996 | Ueno | 333/206 |
| 5,534,829 A | * | 7/1996 | Kobayashi et al. | 333/126 |
| 5,764,118 A | * | 6/1998 | Saito et al. | 333/206 |
| 5,867,076 A | * | 2/1999 | Tada et al. | 333/206 |
| 5,945,896 A | * | 8/1999 | Miyamoto | 333/206 |
| 6,002,309 A | * | 12/1999 | Nishijima et al. | 333/134 |
| 6,087,909 A | * | 6/2000 | Toda et al. | 333/134 |
| 6,150,905 A | * | 11/2000 | Nishijima | 333/206 |

FOREIGN PATENT DOCUMENTS

| | | | |
|---|---|---|---|
| DE | 4408333 A1 | | 9/1994 |
| JP | 410098303 A | * | 4/1998 |

OTHER PUBLICATIONS

Search Report.

* cited by examiner

*Primary Examiner*—Patricia Nguyen
(74) *Attorney, Agent, or Firm*—Ostrolenk, Faber, Gerb & Soffen LLP

(57) ABSTRACT

The present invention provides a dielectric filter capable of increasing a designing freedom for obtaining a desired filter characteristic and capable of producing an attenuation pole in the vicinity of passing frequency band, also to provide a duplexer and communication apparatus formed by using the dielectric filter and the duplexer. In a dielectric block there are formed two through holes of rectangular cross section extending from a first end face to a predetermined depth, with the internal sizes thereof being different from each other. In this way, it is possible to enlarge the ranges obtainable by mutual capacitances on an open face side and a short circuit face side, thereby making it sure to dispose an attenuation pole in the vicinity of a passing frequency band.

4 Claims, 8 Drawing Sheets

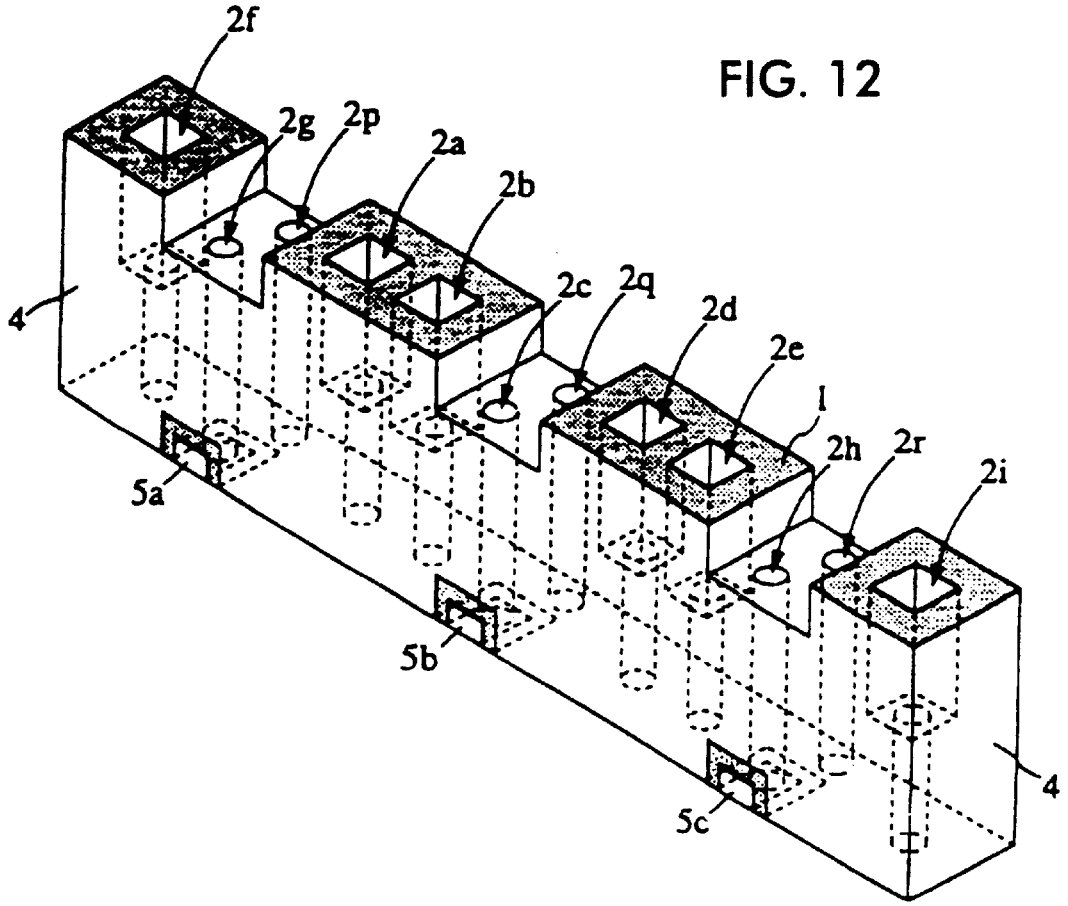
FIG. 12
FIG. 13
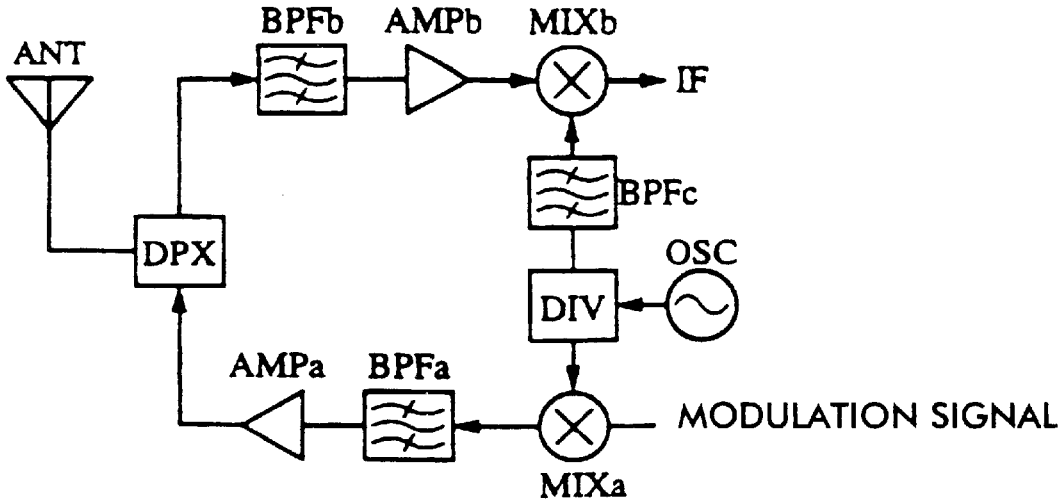

DIELECTRIC FILTER, DUPLEXER AND COMMUNICATION APPARATUS

BACKGROUND OF THE INVENTION

1. Field of the Invention

The present invention relates to a dielectric filter formed by providing electrodes on both inside and outside of a dielectric block, also relates to a duplexer and a communication apparatus fabricated by using the above dielectric filter and the duplexer.

2. Description of the Related Art

Several dielectric filters each formed by providing a plurality of resonators in a dielectric block may be classified into several types, and are used in different ways in accordance with different purposes. As one type of an dielectric filter in which one end face of the dielectric block is used as an open face while an opposite end face is used as a short circuit face, there have been several patent publications which disclose the following arrangements.

(1) Japanese Unexamined Patent Publication No. 6-310911 discloses that electrically conductive materials are disposed in all the surfaces and through holes except the first end face, cross sectional shape of the through holes on the first end face side are made different from that on the second end face side, so that the same resonators are combined together with the characteristic impedance on one side being different from the other.

(2) Japanese Unexamined Utility Model Publication No. 63-181002 discloses that a plurality of through holes are arranged in parallel with one another in a dielectric block, and a coupling hole is provided between these through holes.

(3) U.S. Pat. No. 5,146,193 (Japanese Unexamined Patent Publication No. 6-505608) discloses that through holes having constant cross sections are provided in a dielectric block, and input/output electrodes capable of surface mounting are provided on the side face of the dielectric block.

(4) Japanese Unexamined Patent Publication No. 7-86807 discloses that a plurality of through holes are formed in a dielectric block, one end of each through hole is formed into a short circuit face while the other end thereof is formed into an open face. Further, a recess portion is formed on the open face side; and a conductor is disposed in the recess portion for getting in connection with conductors within the through holes, thereby forming a desired load capacity.

However, with the dielectric filters of the above (1), (2) and (3), when a dielectric block having a pure rectangular parallelepiped shape is used, there is a problem that it is difficult to obtain a large freedom in designing for obtaining a desired characteristic. Moreover, there is no attenuation pole existing in the frequency gain property.

With the dielectric filter of the above (4), the load capacity is created and resonator length is shortened by forming a recess portion on open end face side of each through hole.

SUMMARY OF THE INVENTION

Preferred embodiments of the present invention provide a dielectric filter, a duplexer and a communication apparatus fabricated by using the dielectric filter and the duplexer, all free from the above-discussed problems.

In order to control a coupling coefficient between resonators and to control an attenuation pole frequency, a distance (pitch) between through holes adjacent to each other and a difference (a step ratio) between cross section sizes of the through holes are used as structural parameters, thereby making it possible to change a self-capacitance and a mutual capacitance, both of which may be calculated with the use of the above parameters.

However, in a prior art dielectric filter, since the cross sections of through holes extending from a first end face side to a second end face side are all circular, it is impossible to obtain a necessary capacity value of Cij and a necessary coupling coefficient, all within a range allowed by realizable formation sizes. Further, in order to form an attenuation pole at a frequency in the vicinity of passing frequency band, it is necessary to increase both Cij on the open face side and Cij on the short circuit face side. But, since it is impossible to obtain a necessary capacity value of Cij within a range allowed by realizable formation sizes, it is probably impossible to form an attenuation pole at a desired frequency.

Here, the present invention is a dielectric filter wherein a plurality of through holes are formed in a dielectric block having a generally rectangular parallelepiped shape, extending from a first end face thereof and reaching a second end face thereof opposite to the first end face, internal conductors are provided within the holes, a conductor with its first end face serving as an open face and its second end face serving as a short circuit face is provided on the external surface of the dielectric block, thereby forming a plurality of dielectric resonators, cross sections of the holes are made rectangular, a depth which is 10% to 50% of the hole length extending from the first end face to the second end face is served as a step position, an internal size of each hole extending from the step position to the first end face is different from an internal size of the hole extending from the step position to the second end face.

In this way, since cross sections of the holes formed in the dielectric block are made rectangular, a depth which is 10% to 50% of the hole length extending from the open face is served as a step position, if compared with a case where the cross sectional shape of the through holes are circular, it is possible that Cij may be made large when the coupling coefficient has been made constant. Thus, an attenuation pole may be generated in a position close to a central frequency of a passing frequency band, thereby making it possible to improve a characteristic of an attenuation amount in the vicinity of a passing frequency band.

Further, the present invention is a dielectric filter wherein a plurality of through holes are formed in a dielectric block having a generally rectangular parallelepiped shape, extending from a first end face thereof and reaching a second end face thereof opposite to the first end face, internal conductors are provided within the holes, a conductor with its first end face serving as an open face and its second end face serving as a short circuit face is provided on the external surface of the dielectric block, thereby forming a plurality of dielectric resonators, cross sections of the holes are made rectangular, a depth which is 10% to 50% of the hole length extending from the first end face to the second end face is served as a step position, a cross section of each hole extending from the step position to the first end face is rectangular, and a cross section of the hole extending from the step position to the second end face is circular.

In this way, since the cross sections of the through holes on the short circuit face side having a high electric current density are made into circular shapes, it is possible to avoid a current concentration on top portions of through holes having square cross section, thereby enabling the electric current to be distributed uniformly and thus improving a no-load Q (Qo). Further, since the cross sections of the through holes on the open face side are formed into rectangular shape, it is allowed to increase a designing freedom for designing the above Ci and Cij, thus making it possible that an attenuation pole may be generated in a position closer to a central frequency of a passing frequency band.

Further, according to the present invention, there is provided a duplexer having a plurality of dielectric filters, characterized in that at least one group of dielectric filters are incorporated in a single one dielectric block. In this manner, it is possible to obtain a duplexer comprising a reception filter capable of attenuating a transmission frequency band and allowing the passing of reception frequency band, and a transmission filter capable of attenuating a reception frequency band and allowing the passing of transmission frequency band. Therefore, since it is possible to generate an attenuation pole frequency in the vicinity of a passing frequency band, the above reception filter and the above transmission filter are suitable for use in a case where a transmission frequency band and a reception frequency band are close to each other.

Further, according to the present invention there is provided a communication apparatus characterized in that said device is formed by providing in its high frequency circuit either a dielectric filter or a duplexer. Therefore, it is possible to obtain a communication apparatus which is compact in size and has an excellent characteristic such as an excellent CN ratio of a high frequency circuit section.

BRIEF DESCRIPTION OF THE DRAWINGS

FIG. 12 is a perspective view schematically indicating a duplexer made according to a sixth embodiment of the present invention.

FIG. 13 is a block diagram indicating a high frequency circuit section of a communication apparatus made according to the present invention.

DESCRIPTION OF THE PREFERRED EMBODIMENTS

The constitution of a dielectric filter made according to a first embodiment of the present invention will be described in the following with reference to FIGS. 1A to 7.

FIGS. 1A to 1D are projected plane views indicating the dielectric filter, FIG. 7A is a top plane view, FIG. 7B is a front view, FIG. 7C is a left side view, and FIG. 7D is a right side view. However, a plane shown in FIG. 7B is a mounting surface facing a circuit substrate. In a dielectric block 1 there are formed two mutually parallel elongate holes 2*a* and 2*b* extending from a first end face to a second end face. The cross sectional shapes of the holes 2*a* and 2*b* are rectangular, the internal shape at first end is different from that at a position having a depth L. Further, internal conductors 3*a* and 3*b* are provided within the holes 2*a* and 2*b*. Moreover, on the external surface of the dielectric block 1, there is formed an external conductor 4 whose first end face is formed into an open face while whose second face is formed into a short circuit face. In addition, on the outer surface of the dielectric block 1 there are formed a pair of terminal electrodes 5*a* and 5*b* which are insulated from the external conductor 4.

In FIG. 1, Cio and Cjo are self-capacitances on the open face side, Cis and Cjs are self-capacitances on the short circuit face side, Cijo is a mutual capacitance on the open face side, Cijs is a mutual capacitance on the short circuit face side. In fact, Cio is determined by hbo in the figure, and Cis is determined by hbs in the figure. Further, Cijo is determined by pio and Cijs is determined by pis.

Figure 1A:
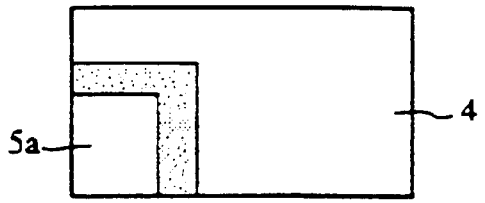
FIG. 1A, FIG. 1B, FIG. 1C and FIG. 1D are projected views schematically indicating a dielectric filter made according to a first embodiment of the present invention.
Figure 1B:
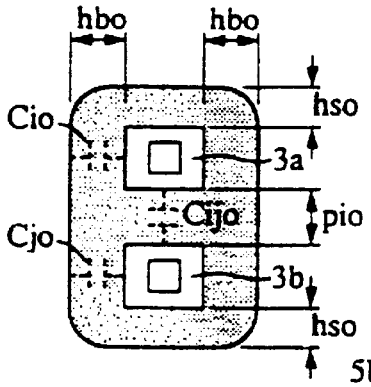
Figure 1C:
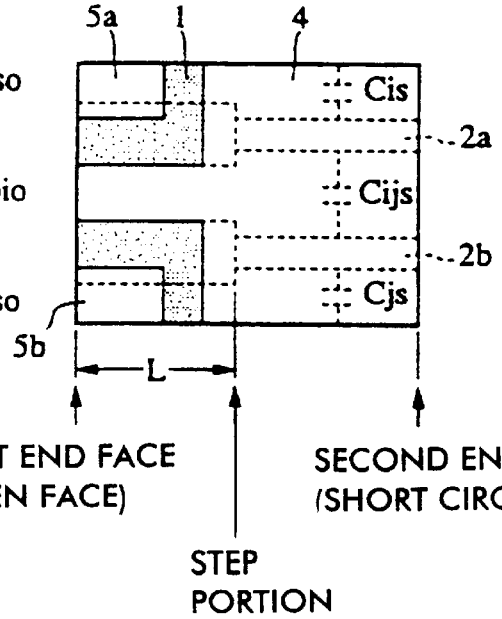
Figure 1D:
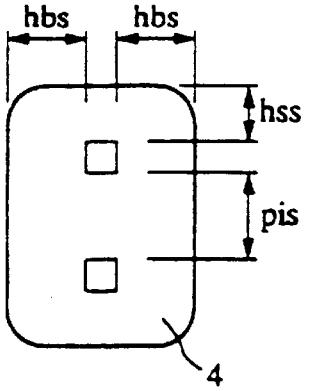
Figure 2A:
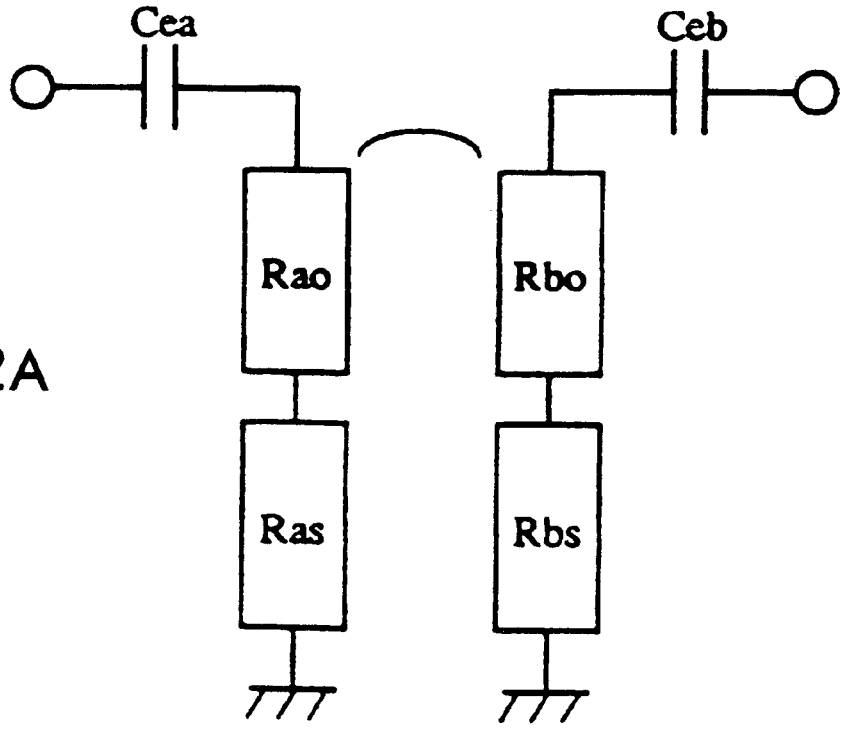
FIG. 2A and FIG. 2B show equivalent circuits for the above dielectric filter.
Figure 2B:
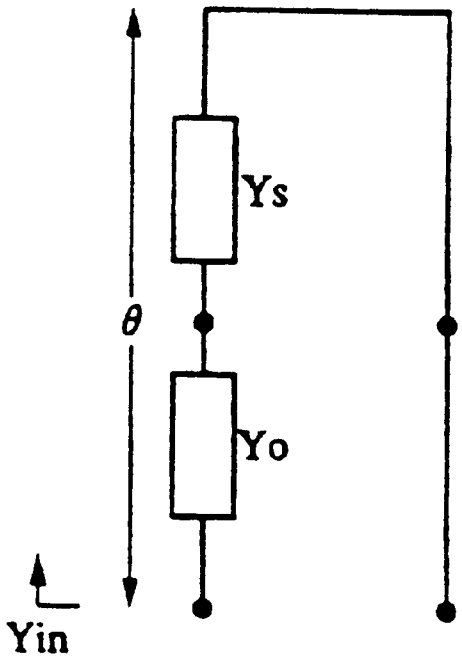

FIGS. 2A and 2B are equivalent circuits for the dielectric filter shown in FIG. 1. FIG. 2A is an equivalent circuit showing an entire condition. Ras is used to represent a resonator on the short circuit face side formed by virtue of the internal conductor 3*a* shown in FIG. 1. Rao is used to represent a resonator on the open face side. Similarly, Rbs is used to represent a resonator on the short circuit face side formed by virtue of the internal conductor 3*b*. Rao is used to represent a resonator on the open face side. Further, Cea is used to represent an electrostatic capacity formed between the terminal electrode 5*a* and the internal conductor 3*a*, Ceb is used to represent an electrostatic capacity formed between the terminal electrode 5*b* and the internal conductor 3*b*, In this way, since the through holes forming the internal conductors are formed into step structures, the characteristic impedance of the resonating path on the open face side is different from that on the short circuit face side, and the same resonators are combined together under such a condition.

FIG. 2B is an equivalent circuit for the above combining section. In this figure, Yo is a characteristic admittance on the open face side, Ys is a characteristic admittance on the short circuit face side, represented by the following equations.

$$Yo=Cijo\ Vc/\sqrt{\in r}$$

$$Ys=Cijs\ Vc/\sqrt{\in r}$$

Here, Vc is a velocity of light, $\in$r is a relative dielectric constant of the dielectric block. Further, in the figure, is an electric length, Yin is an input admittance.

However, a coupling coefficient k may be represented in the following equation.

$$K=J/bo$$

Here, J is an output admittance at a resonant frequency fo, bo is a constant determined by the self-capacitance.

Figure 5A:
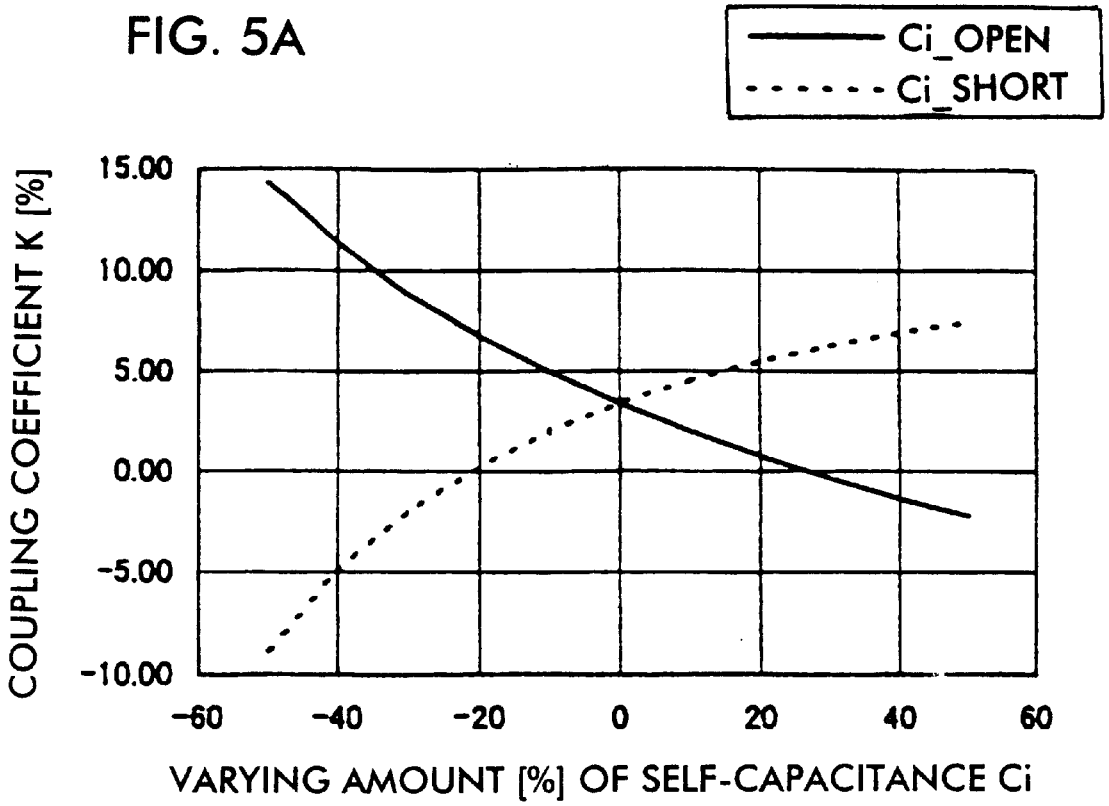
FIG. 5A and FIG. 5B are graphs indicating examples showing a variation of a coupling coefficient with variations of both a self-capacitance and a mutual capacitance.
Figure 5B:
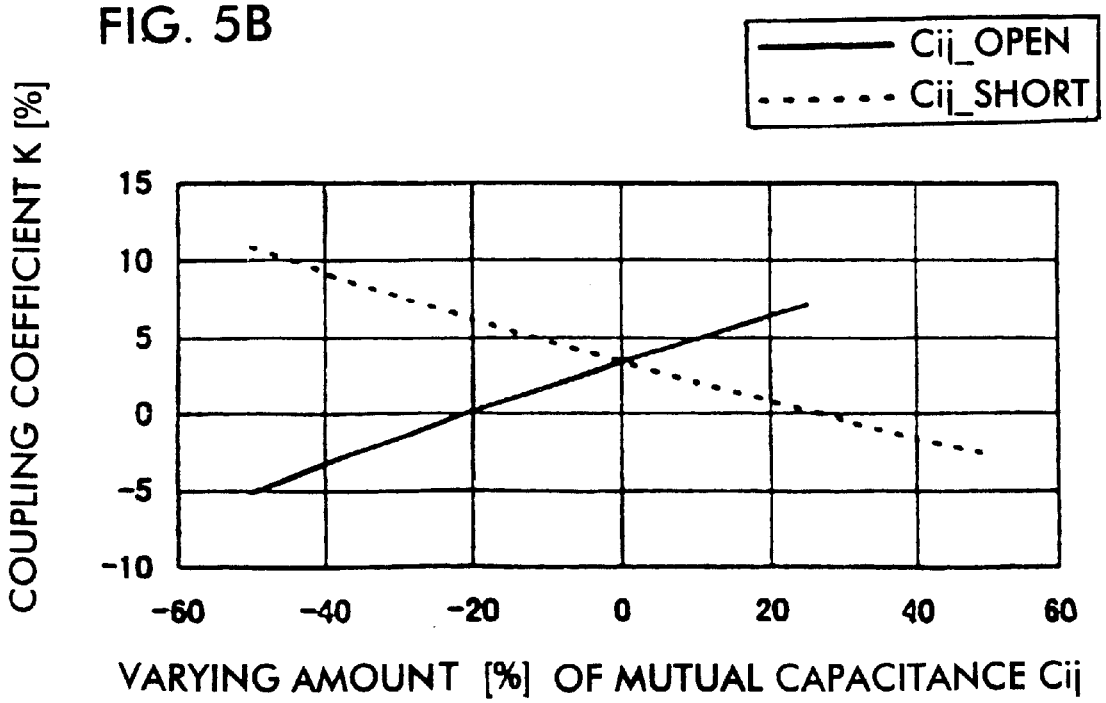

A variation of the coupling coefficient k with the variations of the self-capacitance and the mutual capacitance is shown in FIGS. 5A and 5B. FIG. 5A is used to indicate a variation of the coupling coefficient k when both mutual capacitances Cijo and Cijs are constant and the self-capacitance Ci is changed. In the figure, a solid line is used to indicate a variation of the coupling coefficient with respect to a variation of Cio when Cis is made constant, while a broken line is used to indicate a variation of the coupling coefficient k with respect to Cis when Cio is made constant. Further, FIG. 5B is used to indicate a variation of the coupling coefficient k when both self-capacitances Cis and Cio are constant and the mutual capacitance Cij is changed. In the figure, a solid line is used to indicate a variation of the coupling coefficient when Cijs is made constant and Cijo is changed, while a broken line is used to indicate a variation of the coupling coefficient when Cijo is made constant and Cijs is changed. According to the present invention, since the cross section of the holes forming the internal conductors are formed into rectangular shape, the ranges of Ci and Cij may be set large, thereby increasing a freedom for designing the coupling coefficient k.

Further, the attenuation pole frequency fp is a frequency when two resonators are not combined, namely it may be defined as a frequency when Yin =0.

Since Yin is a function of Cijo and Cijs, Cijo and Cijs for making k and fp to be desired values may be directly determined, with the use of the above relationships.

Figure 3:
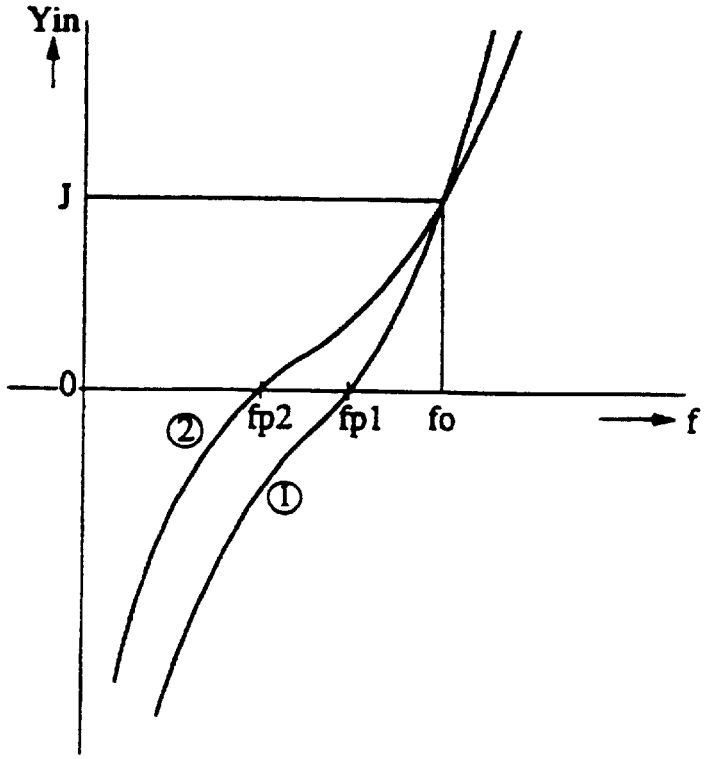
FIG. 3 is a graph indicating a relationship between an input admittance and an attenuation pole at a combining section of the above dielectric filter.

For example, at a frequency fo when the coefficient k is made constant, the large the Cijo and Cijs, the closer the fp will get close to fo. Such kind of relationship is shown in a graph of FIG. 3. In FIG. 3, the horizontal axis is used to represent the frequency and the vertical axis is used to represent an input admittance of the combining section. A frequency when the value of admittance curve becomes 0 is an attenuation frequency. When the input admittance J at the frequency fo is positive (capacitative combination), an attenuation pole will occur at a frequency which is lower than a resonant frequency fo. In contrast, when the input admittance J at the frequency fo is negative (inductive combination), an attenuation pole will occur at a frequency which is higher than a resonant frequency fo. Here, mutual capacitances indicating a characteristic of curve ① is represented to be Cijo1 and Cijs1, when mutual capacitances indicating a characteristic of curve ② is represented to be Cijo2 and Cijs2, the following relationship will exist which are:

$$Cijo1 > Cijo2$$

$$Cijs1 > Cijs2$$

Namely, the larger the Cijo and Cijs, the admittance curve will exist more exactly, thereby making it sure to have the attenuation pole frequency to get close to the resonant frequency fo.

Figure 4:
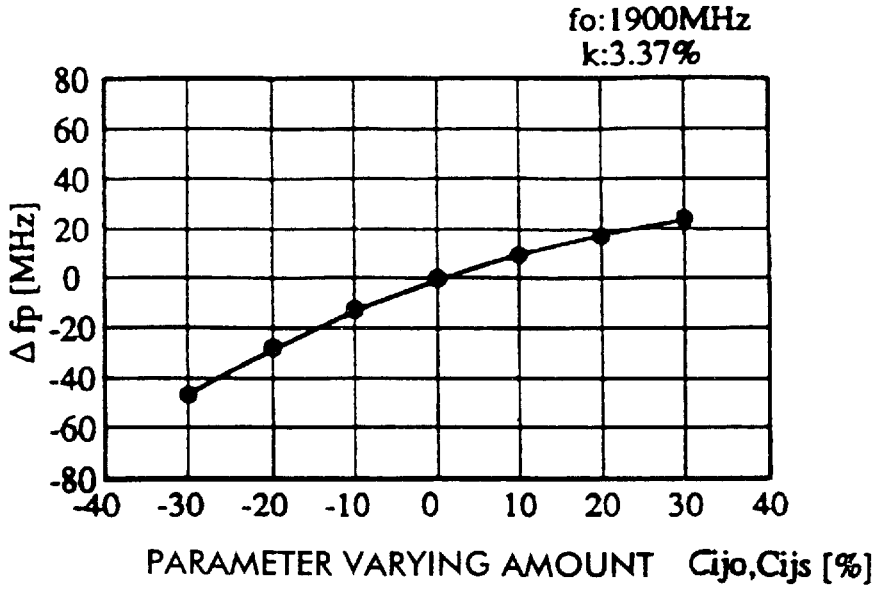
FIG. 4 is a graph indicating an example showing a variation of an attenuation pole with a variation of a mutual capacitance.

FIG. 4 is a graph showing an example indicating a variation of the attenuation pole frequency fp when the above mutual capacitance under a condition of capacitative combination has been changed. Since it is possible to ensure that a larger mutual capacitance will cause an increase in the attenuation pole frequency fp, it is possible to form the attenuation pole in the vicinity of the resonant frequency by forming into rectangular shape the cross sections of the holes forming the internal conductors and by respectively making large the mutual capacitances Cijo and Cijs.

Figure 6:
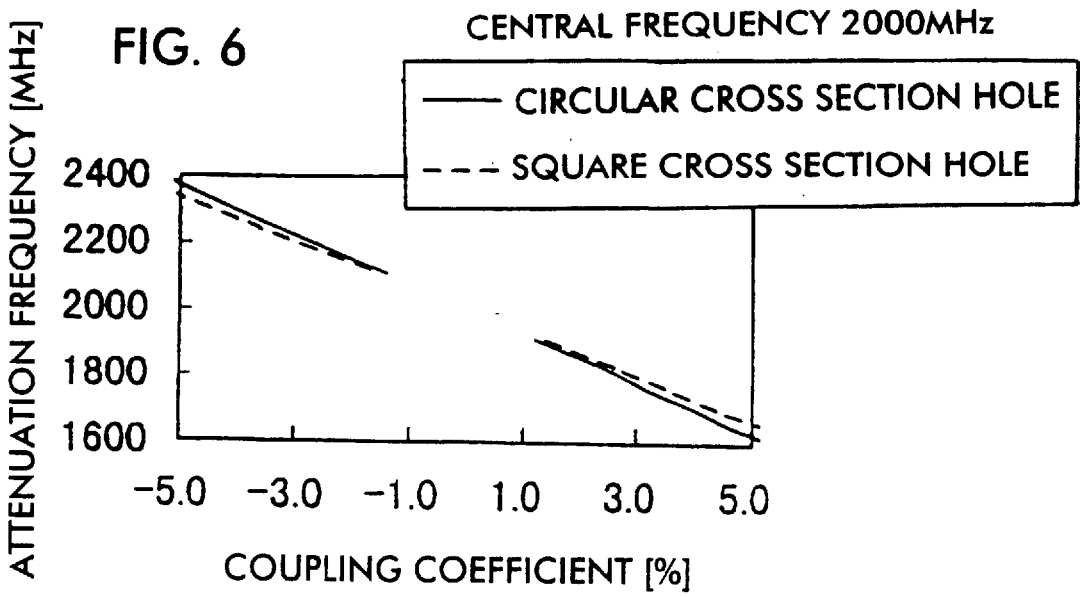
FIG. 6 is a graph indicating a variation width of an attenuation pole frequency with respect to a variation of a coupling coefficient.

FIG. 6 is also a graph showing an example indicating a variation of the attenuation pole frequency when Cij is changed and the coupling coefficient has been changed, under a condition where the cross sections of the holes 2*a* and 2*b* shown in FIG. 1 have been made rectangular and under a condition where the cross sections of the holes 2*a* and 2*b* shown in FIG. 1 have been made circular. In this graph, a broken line is used to indicate a condition where the internal conductors have been formed within the holes having a rectangular cross section, while the solid line is used to represent a condition where the internal conductors have been formed within the holes having a circular cross section. In this way, since it is the cross section of the rectangular shape that can produce a large mutual capacitance, there is only a small change in the attenuation pole frequency fp with respect to a variation of the coupling coefficient. Therefore, it is possible to produce an attenuation pole in a position closer to a desired passing frequency band, irrespective of a width of the passing band.

Figure 7:
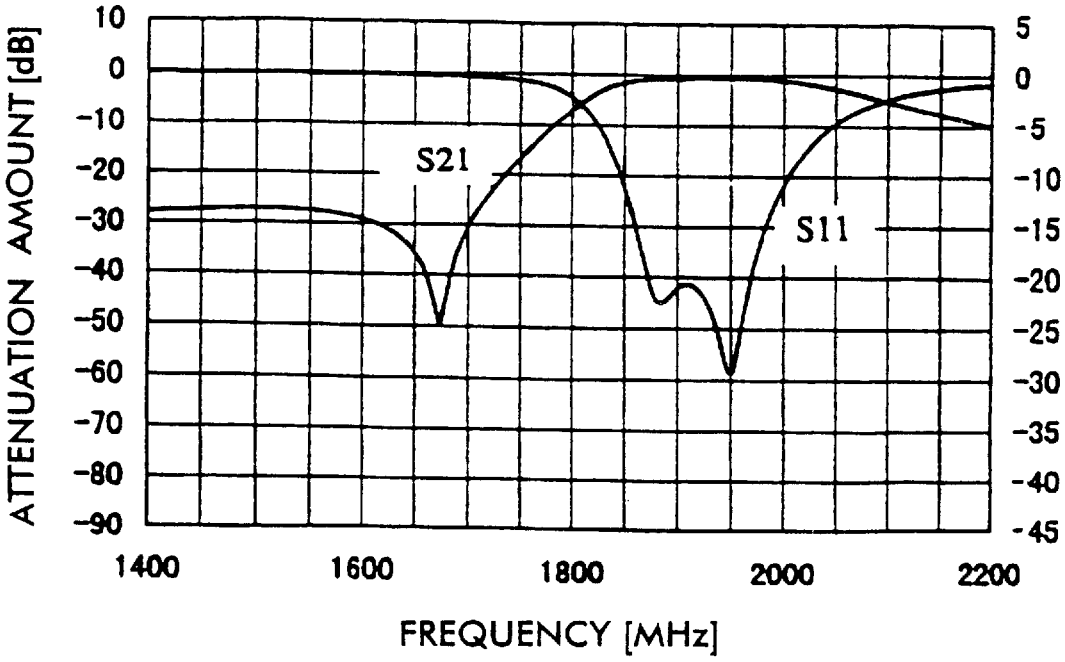
FIG. 7 is a graph indicating a passing characteristic and a reflecting characteristic of a dielectric filter.

FIG. 7 is a graph which is used to indicate a passing characteristic S21 and a reflecting characteristic S11 of the above dielectric filter. In this example, a central frequency is set to be 1900 MHz, the attenuation pole is set at 1670 MHz, thereby obtaining a property that a low frequency band side of the passing area will suddenly drop.

The constitution of a dielectric filter made according to a second embodiment of the present invention will be described in the following with reference to FIG. 8.

Figure 8A:
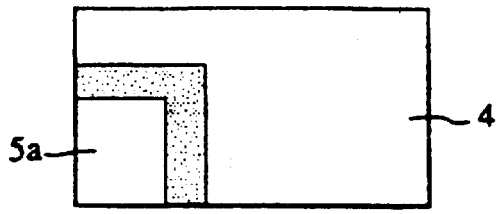
FIG. 8A, FIG. 8B, FIG. 8C and FIG. 8D provide projected views indicating a dielectric filter made according to a second embodiment of the present invention.
Figure 8C:
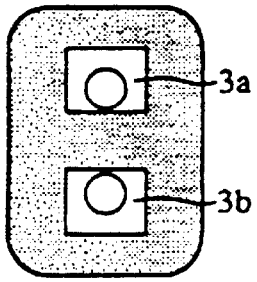
Figure 8B:
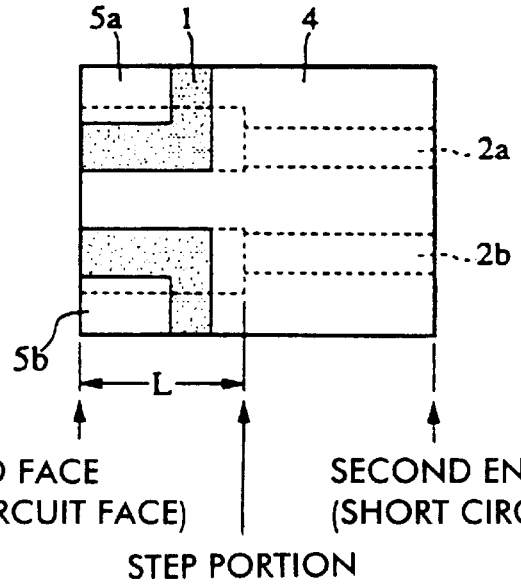
Figure 8D:
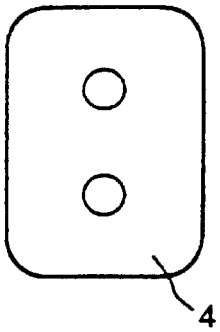

FIG. 8A, FIG. 8B, FIG. 8C and FIG. 8D are projected plane views indicating the dielectric filter, FIG. 8A is a top plane view, FIG. 8B is a front view, FIG. 8C is a left side view, FIG. 8D is a right side view. However, a plane shown in FIG. 8B is a mounting surface facing a circuit substrate. In dielectric block 1 there are formed two mutually parallel elongate holes 2*a* and 2*b* extending from a first end face to a second end face. The cross sectional shapes of the holes 2*a* and 2*b* extending from the first end face (open face) to a position having a depth of L are rectangular, while the cross sectional shapes of the holes 2*a* and 2*b* extending from the position having the depth of L to the second end face (short circuit face) are circular. Further, internal conductors 3*a* and 3*b* are provided within the holes 2*a* and 2*b*. Moreover, on the external surface of the dielectric block 1, there is formed an external conductor 4 whose first end face is formed into an open face while whose second end face is formed into a short circuit face. In addition, on the outer surface of the dielectric block 1 there are formed a pair of terminal electrodes 5*a* and 5*b* which are insulated from the external conductor 4.

With the use of the above structure, it is possible to increase the mutual capacitance Cij by virtue of the internal conductors formed within the holes of rectangular cross section on the open face side. Further, by virtue of the internal conductors formed within the holes of circular cross section on the short circuit face side, it is possible to avoid a concentration of current density and thus ensure a uniform current distribution, thereby improving a no-load property Q.

In a case where an insertion loss characteristic in a passing frequency band and an attenuating amount characteristic in the vicinity of the passing frequency band are seemed to be important at the same extent, what is required to be done is only that the cross sections of the holes on the open face side are made rectangular and that the cross sections of the holes on the short circuit face side are made circular. In addition, when the attenuation amount characteristic in the vicinity of the passing frequency band is particularly required, as in the first embodiment, what is necessary to be done is only that the cross sections of the holes on both the open face side and the short face side are made rectangular.

The constitution of a duplexer made according to a third embodiment will be described in the following with reference to FIG. 9.

Figure 9:
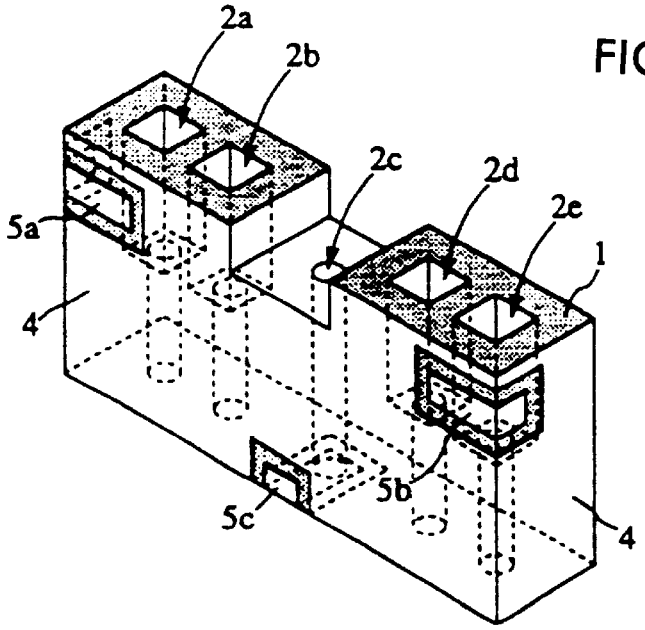
FIG. 9 is a perspective view schematically indicating a duplexer made according to a third embodiment of the present invention.

FIG. 9 is a perspective view schematically indicating the duplexer. Five through holes 2*a* to 2*e* are formed in a dielectric block 1 having a rectangular parallelepiped shape, internal conductors are formed within the internal surfaces of the respective through holes. On the outer surface of the dielectric block 1 is formed an external block 4, with the upper surface in the figure serving as a first end face (open face) and the lower surface thereof as a second end face (short circuit face). The internal conductors within the holes 2*a*, 2*b*, 2*d*, 2*e* are respectively connected with the external conductor located on the lower end shown in the figure. Further, on the outer surface of the dielectric block 1 there are formed terminal electrodes 5*a*, 5*b* and 5*c* which are insulated from the external conductor 4. Moreover, the upper surface over the hole 2*c* is connected with the external conductor 4 and the lower surface thereof is connected with the terminal electrode 5*c*. The internal conductors within the holes 2*a*, 2*e* and the external conductors 5*a*, 5*b* are combined with each other by virtue of an electrostatic capacitance. The internal conductor formed in the hole 2*c* is an excitation hole which is inter-digital connected with the internal conductors of the holes 2*b* and 2*d*.

Referring to FIG. 9, a two-stage resonator formed by virtue of the internal conductors of the holes 2*a* and 2*b* is caused to serve as a transmitting filter having a band pass characteristic, while the terminal electrode 5*e* is used as TX terminal and the terminal electrode 5*c* is used as ANT terminal. The two-stage resonator formed by virtue of the internal conductors of the holes 2*d* and 2*e* is caused to serve as a receiving filter having a band pass characteristic, with the terminal electrode 5*b* serving as an RX terminal.

Figure 10:
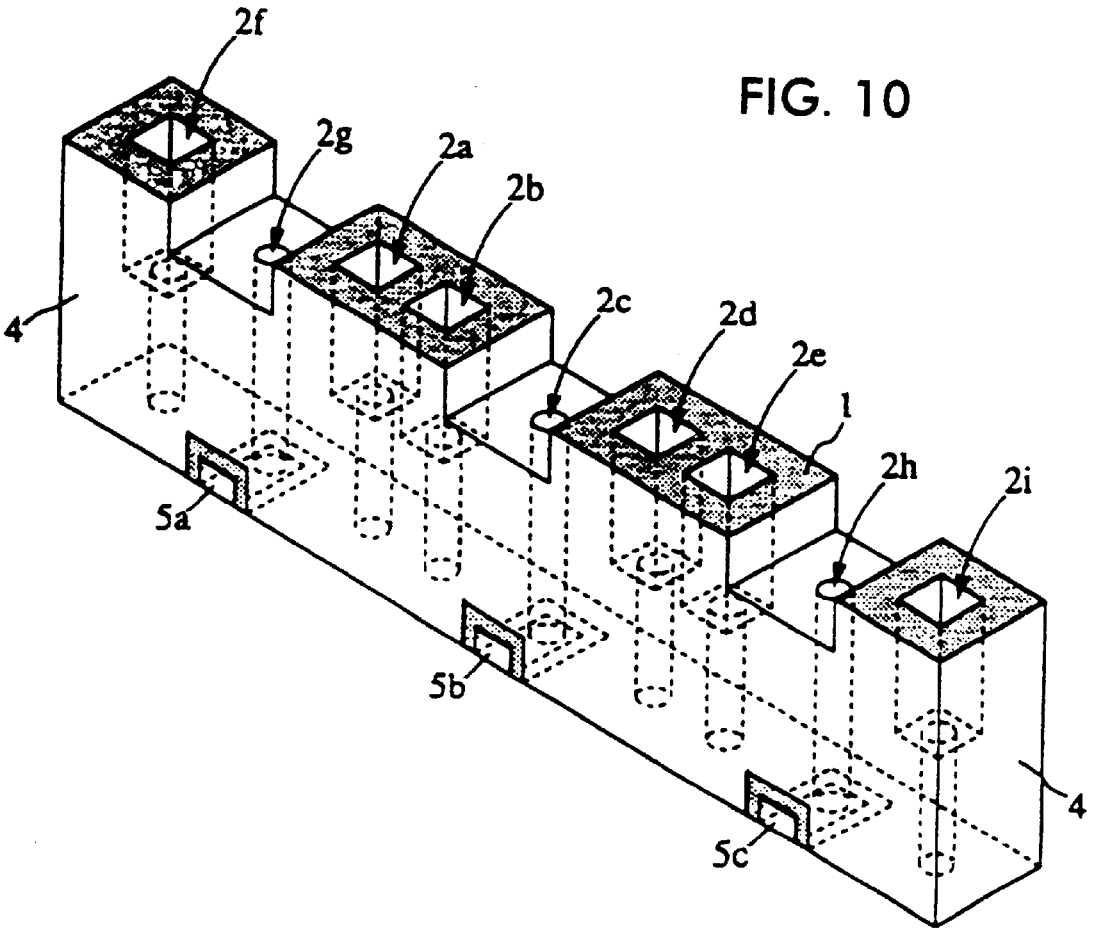
FIG. 10 is a perspective view schematically indicating a duplexer made according to a fourth embodiment of the present invention.

FIG. 10 is a perspective view schematically indicating the constitution of a duplexer made according to a fourth embodiment of the present invention. As may be clearly understood when compared with the duplexer shown in FIG. 9, a plurality of through holes 2*f*, 2*g*, 2*h*, 2*i* are further formed in the dielectric block 1. Lower surfaces of the internal conductors of the through holes 2*f* and 2*i* are connected with the external conductor 4. Further, the upper surfaces of the internal conductors of the holes 2*g* and 2*h* are also connected to the external conductors, while the lower surface thereof are connected to the terminal electrodes 5*a* and 5*c*.

With the use of the above structure, the internal conductors of the holes 2*g* and 2*a* are inter-digital combined. Similarly, the internal conductors of the hole 2*h* and the hole 2*e* are also inter-digital combined. By virtue of this, a strong external combination may be obtained. The internal conductors formed within the holes 2*f* and 2*i* are inter-digital combined with the internal conductors of the holes 2*g* and 2*h*, thereby serving as trap resonator.

A frequency to be attenuated by the trap resonator is allowed to be determined in accordance with an actual purpose. However, when the terminal electrode 5*a* is used as a TX terminal and the terminal electrode 5*c* is used as a RX terminal, if the frequency of the trap resonator using the hole 2*f* is set to be or close to an attenuation pole frequency of the transmission filter formed by virtue of the internal conductors of the holes 2*a* and 2*b*, it is possible to further radically attenuate a frequency band adjacent to the pass band of the transmission filter, or to broaden the frequency band of the attenuation band. Similarly, if the frequency of the trap resonator using the hole 2*i* is set to be or close to an attenuation pole frequency of the reception filter formed by virtue of the internal conductors of the holes 2*d* and 2*e*, it is possible to further radically attenuate a frequency band adjacent to the pass band of the reception filter, or to broaden the frequency band of the attenuation band.

Figure 11:
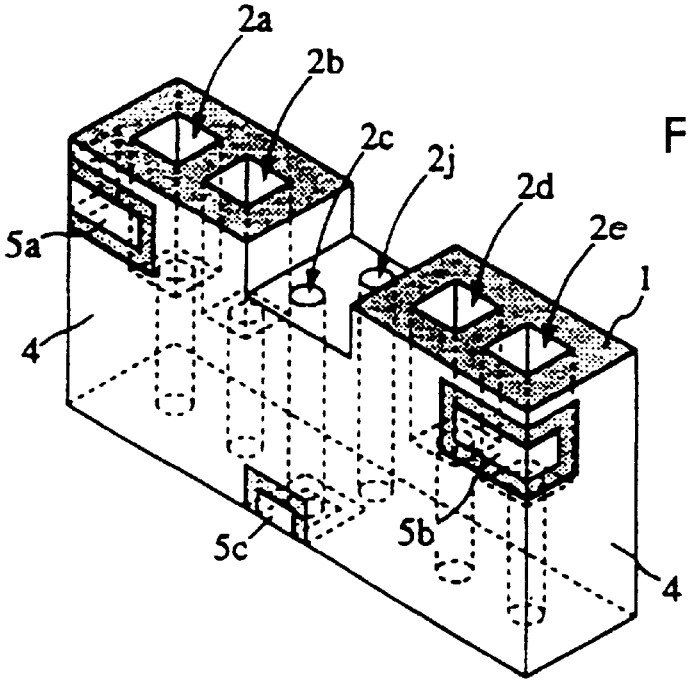
FIG. 11 is a perspective view schematically indicating a duplexer made according to a fifth embodiment of the present invention.

FIG. 11 and FIG. 12 are used to indicate duplexers in which the above inter-digital combining sections have been adjusted. Namely, as shown in FIG. 11, the hole 2*j* is a through hole formed in the vicinity of the hole 2*c*, with both ends of its internal conductor being connected to the external conductor 4. Further, the hole 2*j* can be used as an earth hole, thereby disconnecting the combination between the final stage of the transmitting filter and the initial stage of the reception filter. Other structures and functions are just the same as those shown in FIG. 9.

Referring to FIG. 12, holes 2*p*, 2*q* and 2*r* are through holes formed in the vicinity of the holes 2*g*, 2*c* and 2*h*, with each ends of their internal conductors being connected to the external conductor 4. These holes are used as earth holes, while an earth hole formed by virtue of the hole 2*p* can serve to disconnect the combination of two resonators formed by virtue of the holes 2*f* and 2*a*. Similarly, the earth hole formed by virtue of the hole 2*q* can serve to disconnect the combination of two resonators formed by virtue of the holes 2*b* and 2*d*, while the earth hole formed by virtue of the hole 2*r* can serve to disconnect the combination of two resonators formed by virtue of the holes 2*e* and 2*i*. Other structures and functions are just the same as those shown in FIG. 10.

Next, the constitution of a communication apparatus formed by using the above dielectric filter or the duplexer will be described with reference to FIG. 13. As shown in the figure, ANT is a transmitting/receiving antenna, DPX is a duplexer. BPFa, BPFb and BPFc are band pass filters, respectively. AMPa and AMPb are amplifying circuits, respectively. MIXa and MIXb are mixers, respectively. OSC is an oscillator, DIV is a frequency divider (synthesizer). MIXa is used to modulate a frequency signal from DIV with the use of a modulation signal. BPFa is used to allow the passing of only a transmission frequency band, AMPa is used to amplify the signal of the frequency band, so that the signal is transmitted from ANT by way of DPX. BPFb is used to allow the passing of only a reception frequency band selected from the signals outputted from the DPX, while AMPb is used to amplify the signal of the frequency band. MIXb is used to mix the frequency signal from the BPFc and a received signal so as to produce an intermediate frequency signal IF.

The duplexer DPX shown in FIG. 13 employs duplexers having the structures shown in FIGS. 9 to 12. Further, the above BPFa, BPFb and BPFc are formed by using the dielectric filters having the structures shown in FIG. 1 or FIG. 8. In this way, since it has been possible to use the dielectric filters or duplexers capable of passing only a necessary frequency band with a low insertion loss and capable of greatly attenuating a signal of an unnecessary frequency band, it is sure to obtain a communication apparatus having a high frequency circuit of a high CN ratio, which is compact in total size and has a high electric power efficiency.

With the use of the present invention, since cross sections of the holes formed in the dielectric block are made rectangular, a depth which is 10% to 50% of the hole length extending from the open face is served as a step position, if compared with a case where the cross sectional shape of the through holes are circular, it is possible that Cij may be made large when the coupling coefficient is made constant. Thus, an attenuation pole may be generated in a position close to a central frequency of a passing frequency band, thereby making it possible to improve a characteristic of an attenuation amount in the vicinity of a passing frequency band.

Further, with the use of the present invention, since the cross sections of the through holes on the short circuit face side having a high electric current density are formed into circular shapes, it is possible to avoid a current concentration on top portions of through holes having square cross section, thereby enabling the electric current to be distributed uniformly and thus improving a no-load Q (Qo). Further, since the cross sections of the through holes on the open face side are formed into rectangular shape, it is allowed to increase a designing freedom for designing the above Ci and Cij, thus making it possible that an attenuation pole may be generated in a position closer to a central frequency of a passing frequency band.

Further, with the use of the present invention, since the reception filter and the transmission filter are formed so that it is possible to generate an attenuation pole frequency in the vicinity of a passing frequency band, they are suitable for use in a case where a transmission frequency band and a reception frequency band are close to each other.

Further, with the use of the present invention, it is possible to obtain a communication apparatus which is compact in size and has an excellent characteristic such as an excellent CN ratio of a high frequency circuit section.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter, comprising:

a dielectric block having a generally rectangular parallelepiped shape;

a plurality of through holes provided in the dielectric block, extending from a first end face thereof and reaching a second end face thereof opposite to the first end face;

internal conductors provided within the through holes; and a conductor provided on the external surface of the dielectric block, with the first end face of the dielectric block serving as an open circuit face and the second end face of the dielectric block serving as a short circuit face; thereby forming a plurality of dielectric resonators; wherein cross sections of the holes are rectangular, each hole of the plurality of holes has a large-size portion and a small-size portion which are connected to each other at a step portion, and the large-size portions are of the same length and are arranged at the first end face and the small-size portions are arranged at the second end face;

the step portion being disposed at a depth which is greater than 25% and less than 50% of the hole length extending from the first end face to the second end face.

2. A communication apparatus comprising the dielectric filter of claim 1, further comprising at least one of a transmitting circuit and a receiving circuit connected to said dielectric filter.

3. A dielectric filter as in claim 1, further comprising a second plurality of dielectric resonators provided in said dielectric block, whereby said plurality of dielectric resonators and said second plurality of dielectric resonators provide respective filter portions of a duplexer in said dielectric block.

4. A communication apparatus comprising the dielectric filter of claim 3, further comprising at least one of a transmitting circuit and a receiving circuit connected to said dielectric filter.

* * * * *